United States Patent [19]

Lemke et al.

[11] Patent Number: 4,692,217

[45] Date of Patent: Sep. 8, 1987

[54] READJUSTMENT DEVICE FOR COKE OVEN BATTERIES

[75] Inventors: Otto Lemke, Recklinghausen; Manfred Krause, Herten-Langenbochum, both of Fed. Rep. of Germany

[73] Assignee: Firma Carl Still GmbH & Co. KG, Fed. Rep. of Germany

[21] Appl. No.: 760,314

[22] Filed: Jul. 29, 1985

[30] Foreign Application Priority Data

Jul. 28, 1984 [DE] Fed. Rep. of Germany ..... 3427991

[51] Int. Cl.[4] ..... C10B 21/10; C10B 21/14

[52] U.S. Cl. ..... 202/151; 74/108; 202/141

[58] Field of Search ..... 202/141, 142, 143, 144, 202/151, 270, 239; 74/89.2, 89.21, 89.22, 108, 517; 137/309

[56] References Cited

U.S. PATENT DOCUMENTS

| | | | |
|---|---|---|---|
| 3,630,222 | 12/1971 | Tucker | 202/143 |
| 3,751,342 | 8/1973 | Gidick | 202/141 |
| 4,085,008 | 4/1978 | Kinzler | 202/151 |
| 4,159,924 | 7/1979 | Lemke et al. | 202/142 |

FOREIGN PATENT DOCUMENTS 1188553 3/1965 Fed. Rep. of Germany .

*Primary Examiner*—Barry S. Richman
*Assistant Examiner*—Joye L. Woodward
*Attorney, Agent, or Firm*—McGlew and Tuttle

[57] ABSTRACT

The invention relates to a readjustment device on coking oven batteries with linkages, disposed in a master gallery so as to be movable in the longitudinal direction of the battery, for the actuation of shutoff members on the individual ovens of the coking oven battery. The linkages, to be moved simultaneously and oppositely in the master gallery, are joined to each other at one end of the coking oven battery through a guide pulley and this guide pulley is provided with pulley segments having different radii to obtain different strokes at the linkages.

13 Claims, 2 Drawing Figures

READJUSTMENT DEVICE FOR COKE OVEN BATTERIES

FIELD AND BACKGROUND OF THE INVENTION

This invention relates in general to coke ovens and in particular to a new and useful mechanism for operating shutoff members of individual coke ovens of a coke oven battery.

The invention relates particularly to a readjustment device on coke oven batteries with linkages, disposed in the master gallery so as to be movable in the longitudinal direction of the battery, for the actuation of the shutoff members on the individual ovens of the coke oven battery.

Known from German No. AS 11 88 553 is a readjustment device for the regeneratively heated coke oven batteries in which the gas cocks, the waste heat valves, and the air flaps of the individual ovens are connected to linkages actuated by hydraulically operated working cylinders fed via a control unit. For actuation in one direction, a pressure medium is admitted to the working cylinders, and for the return of the pressureless working cylinders, counterweights, mounted at the other end of the battery, are provided. This arrangement requires a separate working cylinder and a separate counterweight of considerable size for each individual linkage to actuate the gas cocks, waste heat valves, and air flaps. Especially when coke oven batteries are heatable with lean gas and rich gas, possibly with waste heat flues and gas lines disposed on the coke side or on the machine side only, there is not enough room for such arrangements.

Also known from German No. PS 21 64 203 is a device for the mechanical readjustment of the valves of a coke oven battery in which the readjusting machine is connected by actuating rods to a chain construction running around the coke oven battery. This construction requires a great deal of space in the end zones of the batteries and does not make sense especially when the gas and waste heat ducts are provided on one side (machine side or coke side) of the battery only. The simultaneous actuation of shutoff members on the machine side as well as the coke side is possible only if they also have the same stroke on both sides.

SUMMARY OF THE INVENTION

The invention provides a readjusting device which is of space-saving design and operates without counterweights and without having to circle the entire coke oven battery.

According to the invention, valves to be moved simultaneously and oppositely in a master gallery, are connected to each other at one end of the coke oven battery through a guide pulley. This guide pulley is provided with pulley segments of different radii to obtain different strokes at the linkages.

Due to the arrangement according to the invention it is possible, especially when coke oven batteries with so called lengthwise regenerators going through from the coke side to the machine side are involved, to feed in or discharge the combustion media and/or the waste heat from one side, it then being possible to execute several simultaneous readjusting operations in which the readjusting linkages move in opposite directions. The actuation mechanisms such as hydraulic cylinders may then be provided at one end of the battery and a maximum of two hydraulic cylinders is required to actuate e.g. two readjusting linkages. In a readjusting operation, one hydraulic cylinder purposefully pulls one linkage while the hydraulic cylinder on the other linkage is pulled along without pressure for opening the valves. At the other end of the battery, both readjusting linkages are connected to a guide pulley assembly, the linkages being disposed at different distances from the guide pulley shaft to compensate for different linkage strokes. The greater stroke linkage is disposed further away from, and the shorter stroke linkage closer to, the guide pulley shaft. The two fastening points on the guide pulley assembly move along different circular arcs to actuate the readjusting linkages. This makes it possible to bring about different translatory motions of the readjusting linkages by means of one guide pulley assembly. A simple, space-saving, material-saving, and operationally safe design is obtained in this manner.

To set different linkage distances in both horizontal and vertical direction the invention suggests the provision of at least one guide roller near the guide pulley assembly or, the guide pulley assembly may be tilted, the pulley segments may also be disposed at different levels on the central, vertical guide pulley shaft. This makes it possible in a simple manner to obtain a readjustment linkage arrangement in the master gallery to meet the requirements in every direction.

According to the invention, the connection between the linkages and fastening at the guide pulley may advantageously consist of movable elements such as ropes, chains, and in particular multiple roller chains or flyer chains. To simplify assembly and the setting of the fastening points on the guide pulley assembly, a turnbuckle may be provided in at least one linkage. In addition, the invention provides for the guide pulley assembly to be mounted adjustably and/or elastically in the longitudinal direction of the battery. This makes it possible to compensate, in a simple manner, for changes in length due to temperature fluctuations or high stresses in tension.

Finally, it has proven to be advantageous to mount the guide pulley shaft in an inner box which is movable in the longitudinal direction of the battery and guided in elongated holes of an outer, stationary box. These boxes, nested in one another, prevent in particular a lateral tilting and canting of the guide pulley assembly. The outer box may be mounted to its stationary mount by only a few fastening and adjusting screws.

Accordingly it is an object of the invention to provide an improved device for actuating shutoff members of individual coke ovens of a coke oven battery which comprises a plurality of actuating linkages which are connected to the shutoff members and an actuating mechanism connected to the linkages which includes a guide pulley assembly of individual pulley segments of different radii which are rotatably mounted on a common axis and which are connected through a flyer chain or similar connecting member for each pulley segment connected between a circumferential end of the pulley segment and an associated linkage.

A further object of the invention is to provide an actuating linkage for coke ovens which is simple in design rugged in construction and economical to manufacture.

The various features of novelty which characterize the invention are pointed out with particularity in the claims annexed to and forming a part of this disclosure.

For a better understanding of the invention, its operating advantages and spcific objects attained by its uses, reference is made to the accompanying drawings and descriptive matter in which a preferred embodiment of the invention is illustrated.

DESCRIPTION OF THE PREFERRED EMBODIMENTS

Figure 1:
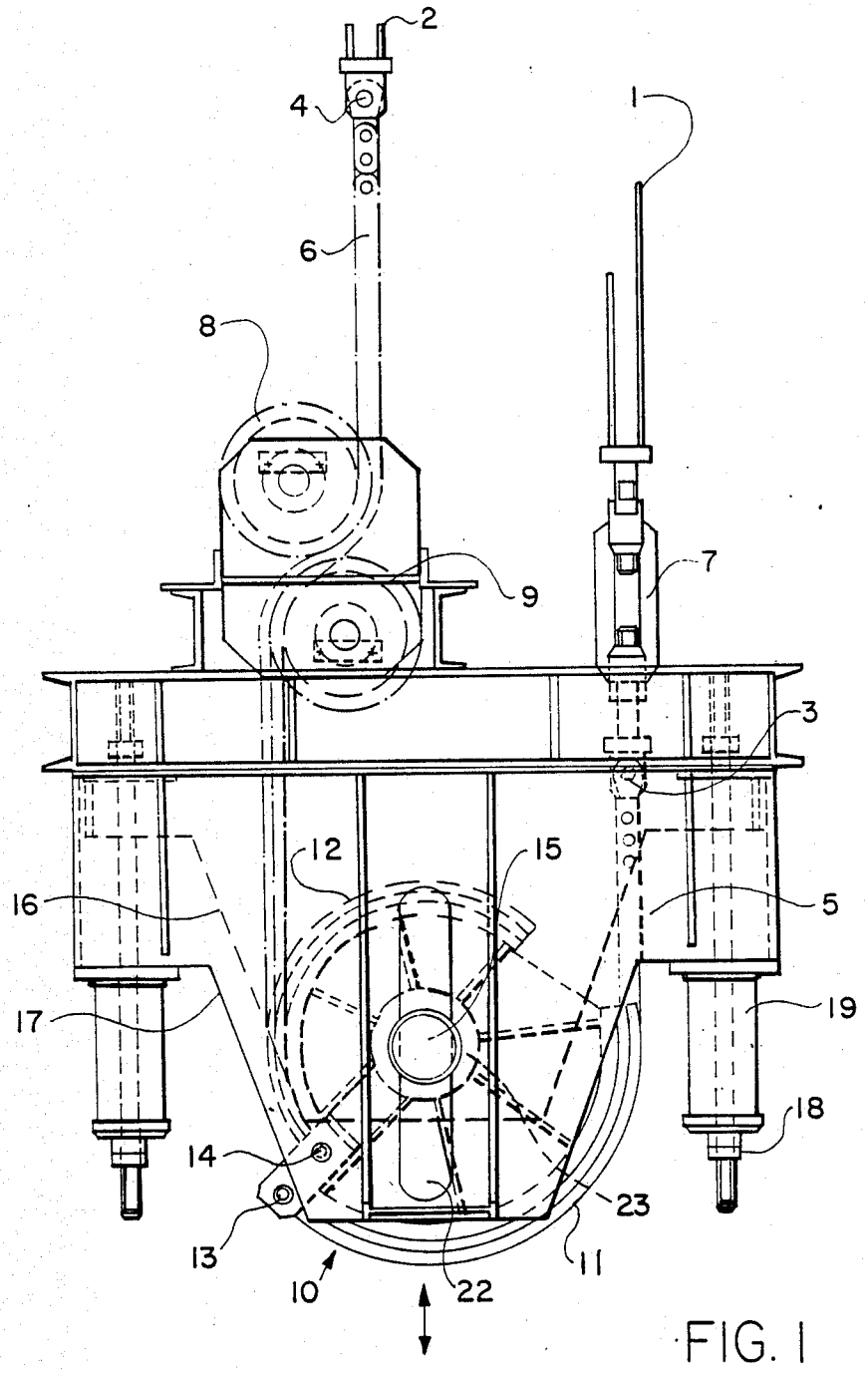
FIG. 1 is a top plan view of a schematic guide pulley arrangement at the end of the readjusting linkages in accordance with the invention.
Figure 2:
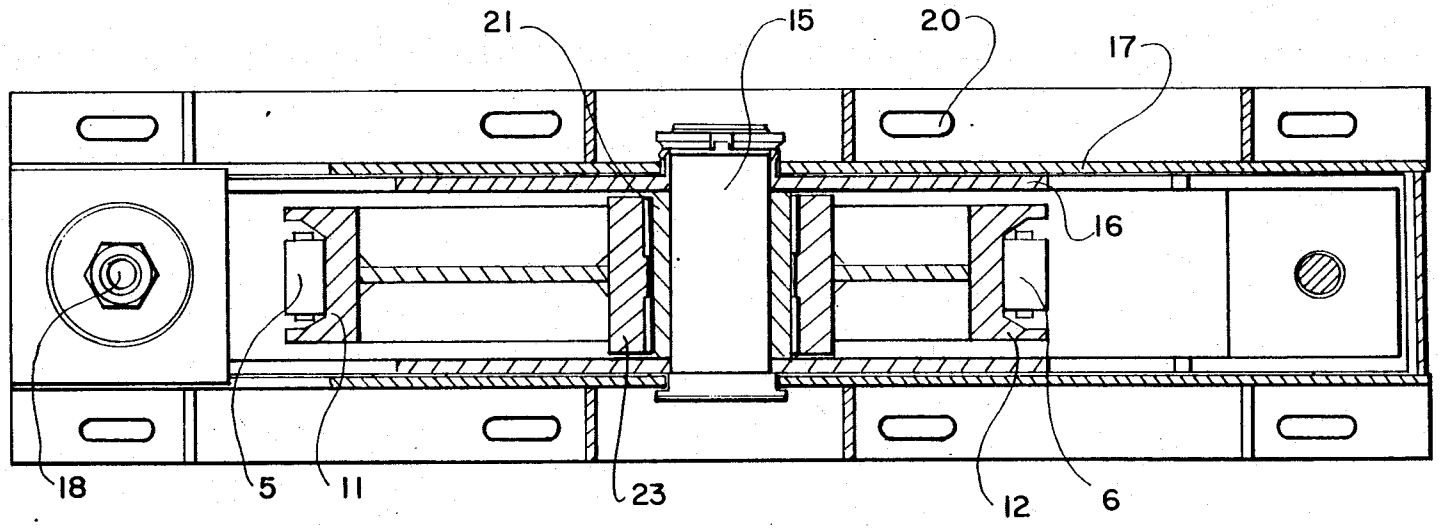
FIG. 2 is a transverse section of the guide pulley arrangement with the inner and outer boxes.

Referring to the drawings in particular the invention embodied therein comprises a device for actuating shutoff members of individual coke ovens of a coke oven battery, which comprises a plurality of linkages 1 and 2 which are connected to the shutoff members (not shown) and which are moved for actuating these members. The device comprises an actuating mechanism connected to the linkages which includes a guide pulley assembly 10 of individual pulley segments 11 and 12, having circular arcs with different radii which are rotatably mounted on a common axis or pulley shaft 15. A flexible connecting member such as flyer chains 5 and 6 for each pulley segment is connected between a circumferential fastening point 13 or 14 of a selected pulley segment 11 and 12, and an associated linkage 2 or 1. As shown in FIGS. 1 and 2 each pulley segment is connected to a common hub 25 that can rotate around shaft 15.

Indicated in FIG. 1 are the two ends of the readjusting linkages 1 and 2 which are fastened to the pulley segments 11 and 12 via joints 3 and 4, the flyer chains 5 and 6 and the fastening points 13 and 14. A turnbuckle 7 is additionally provided on the one readjusting linkage 1, and two guide rollers 8 and 9 are provided at the other readjusting linkage 2 in the area of the flyer chain 6. The vertical shaft 15 of the guide pulley assembly 10 is mounted in an inner box 16 and on a bearing sleeve 21 that is fixed to the box 16, as evident particularly from FIG. 2. The shaft 15 is also adjustable in an outer box 17 and in longitudinal direction of the battery by means of the adjusting screws 18. As may be seen from FIG. 1, packs of Belleville washers 19 are additionally mounted on the adjusting screws 18. Finally, the outer box 17 is fixed at the fastening points 20. Shaft 15 can ride in longitudinal slots 22 provided in box 17 and box 16 can move longitudinally in box 17 due to rotation of screws 18 which are engaged between boxes 16 and 17, on opposite sides of pulley assembly 10. Boxes 16 and 17 form first and second support members for the pulley assembly.

While a specific embodiment of the invention has been shown and described in detail to illustrate the application of the principles of the invention, it will be understood that the invention may be embodied otherwise without departing from such principles.

What is claimed is:

1. A device for moving two linkages in opposite directions, each linkage being adapted for connection to its own set of shutoff circuit members of individual coke ovens of a coke oven battery, the device comprising two linkages, a guide pulley assembly having an axis and two pulley segments which are connected to each other, said pulley segments being mounted to each other for common rotation around said axis, each pulley segment including a curved arc portion having a radius from said axis which is different from the radius of the curved arc portion of the other pulley segment, each arc portion having a circumferential fastening point, support means mounting said guide pulley assembly for rotation of said pulley segments around said axis, two flexible connecting members, each flexible connecting member having one end connected to one of said fastening points and an opposite end, each flexible connecting member being engagable against and trained around said curved arc portion of its pulley segment in opposite directions around said axis with said opposite ends of said connecting members being movable by different amounts and in opposite directions with rotation of said pulley segments due to the difference in radii of said curved arc portions, one of the linkages being connected to said opposite end of one flexible connecting member and the other of the linkages being connected to said opposite end of the other flexible connecting member so that rotation of said pulley segment around said axis caused the linkages to move in opposite directions and by different stroke lengths.

2. A device according to claim 1 wherein guide pulley assembly includes a pulley shaft extending along said axis, a hub mounted for rotation around said pulley shaft and both of said pulley segments being fixed to said hub.

3. A device according to claim 2 wherein said curved arc portions of said pulley segments are each circular, said fastening points are located at one end of each respective circular arc.

4. A device according to claim 3 wherein each of said flexible connecting members comprises a flyer chain.

5. A device according to claim 4 including a turnbuckle connected between the opposite end of one of said flyer chains and its respective linkage for changing an effective length of said flyer chain and its linkage.

6. A device according to claim 5 including a pair of guide rollers engaged on opposite sides of the other of said flyer chains, said guide rollers bending the other of said flyer chains for changing the effective length thereof from its one end to its opposite end.

7. A device according to claim 6 wherein said support means comprises a first support member carrying said pulley shaft and a second support member carrying said first support member for movement of said first support member so that said pulley shaft can be moved to move said opposite ends of said flyer chains together in the same direction.

8. A device according to claim 7 wherein said first support member comprises an inner box carrying said pulley shaft and said second support member comprises a second box engaged round said first box.

9. A device according to claim 8 including a plurality of screws engaged between said inner and outer boxes for moving said inner box with respect to said outer box.

10. A device according to claim 1 including a turnbuckle connected between said opposite end of one of said flexible connecting members and its linkage for changing the effective length of said one flexible connecting member and its linkage.

11. A device according to claim 1 including a pair of guide rollers engaged on opposite sides of one of said flexible connecting members for bending said one flexible connecting member to change its effective length between its one end and its opposite end.

12. A device according to claim 1 wherein said support means comprises a first support member on which said guide pulley assembly is mounted for rotation of said pulley segments around said axis, and a second support member carrying said first support member for movement of said first support member with respect to said second support member for moving said opposite ends of said flexible members together in the same direction.

13. A device according to claim 12 wherein said first support member comprises an inner box, said second support member comprising an outer box engaged round said inner box, and a plurality of screws engaged between said inner and outer boxes for moving said inner and outer boxes with respect to each other.

* * * * *